US007373911B2

(12) United States Patent
Taguchi

(10) Patent No.: US 7,373,911 B2
(45) Date of Patent: May 20, 2008

(54) OIL RETURN DEVICE

(75) Inventor: Arata Taguchi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/788,097

(22) Filed: Apr. 19, 2007

(65) Prior Publication Data

US 2007/0246001 A1 Oct. 25, 2007

(30) Foreign Application Priority Data

Apr. 20, 2006 (JP) ..... 2006-116485

(51) Int. Cl.
*F02B 77/00* (2006.01)

(52) U.S. Cl. ..... 123/195 C; 123/196 R

(58) Field of Classification Search ..... 123/195 C, 123/196 R; 184/6.5
See application file for complete search history.

(56) References Cited

U.S. PATENT DOCUMENTS 2,440,815 A * 5/1948 Wharam et al. ..... 184/6.2
4,630,580 A * 12/1986 Sawaki et al. ..... 123/196 R
5,852,992 A * 12/1998 Boggs et al. ..... 123/196 R

FOREIGN PATENT DOCUMENTS

JP 09049414 2/1997
JP 2006283728 10/2006

* cited by examiner

*Primary Examiner*—Noah P. Kamen
(74) *Attorney, Agent, or Firm*—Global IP Counselors, LLP

(57) ABSTRACT

An engine oil return device for an engine having a cylinder head and a cylinder block is disclosed. The oil return device comprises an oil pan and an oil return path. The oil return path includes at least one oil return main path and at least one oil return extension path. The oil return main path is disposed at a first side surface of the cylinder block. The oil return extension path includes an upstream end and a downstream end. The upstream end is connected to the oil return main path. The downstream end is positioned at a distance from the first side surface such that the oil return extension path extends in a direction of the second side surface of the cylinder block. At least a portion of the oil return extension path is defined by a portion of the oil pan.

11 Claims, 5 Drawing Sheets

OIL RETURN DEVICE

BACKGROUND

1. Technical Field

The present disclosure relates to an engine oil return device for returning oil that has lubricated portions of a cylinder head to an oil pan, through a cylinder block.

2. Description of the Related Art

Japanese Unexamined Patent Application Publication No. 09-049414 describes an engine lubricating system that uses a wet sump method in which oil in an oil pan is sucked up by an oil pump and is supplied to each part of the cylinder head by pressure. The oil that has lubricated each portion of the cylinder head is circulated as a result of returning the oil to the oil pan from a cylinder head.

For example, in a V-type engine, an oil return path for returning oil to an oil pan from a cylinder head is provided so as to be inclined along both sides of an engine. Therefore, when acceleration in a front-back direction or a lateral direction of a vehicle, which causes the oil to be inclined towards the oil return path, is increased, the oil may no longer be returned by gravitational force through the oil return path. Moreover, when an inclination angle of a bank from a vertical direction is large, a reverse flow is produced in the oil return path, thereby causing the circulation of the oil to be hindered.

SUMMARY

An engine oil return device for an engine having a cylinder head and a cylinder block is disclosed. The oil return device comprises an oil pan and an oil return path. The oil return path includes at least one oil return main path and at least one oil return extension path. The oil return main path is disposed at a first side surface of the cylinder block. The oil return extension path includes an upstream end and a downstream end. The upstream end is connected to the oil return main path. The downstream end is positioned at a distance from the first side surface such that the oil return extension path extends in a direction of the second side surface of the cylinder block. At least a portion of the oil return extension path is defined by a portion of the oil pan.

According to the above-described structure, when an acceleration that causes oil in the oil pan to be inclined towards an engine-body side surface (provided at a side where the at least one oil returning main path is provided) is produced, since the at least one oil returning extension path is connected to the at least one oil returning main path and extends towards a side that is opposite to a side where the oil is inclined, and because that corresponds to a side where the oil is carried away, reverse flow of a large amount of oil, caused by the production of the acceleration, is restricted.

Therefore, even if a vehicle is suddenly accelerated, decelerated, or turned, the oil is properly returned to the oil pan, so that it is possible to prevent improper lubrication and an increase in oil consumption.

In addition, since the at least one oil returning extension path is defined by a portion of the oil pan, it is possible to save space and to restrict an increase in the number of parts.

BRIEF DESCRIPTION OF THE DRAWINGS

Other features and advantages of the present disclosure will be apparent from the ensuing description, taken in conjunction with the accompanying drawings, in which.

DESCRIPTION OF THE PREFERRED EMBODIMENT

Figure 1:
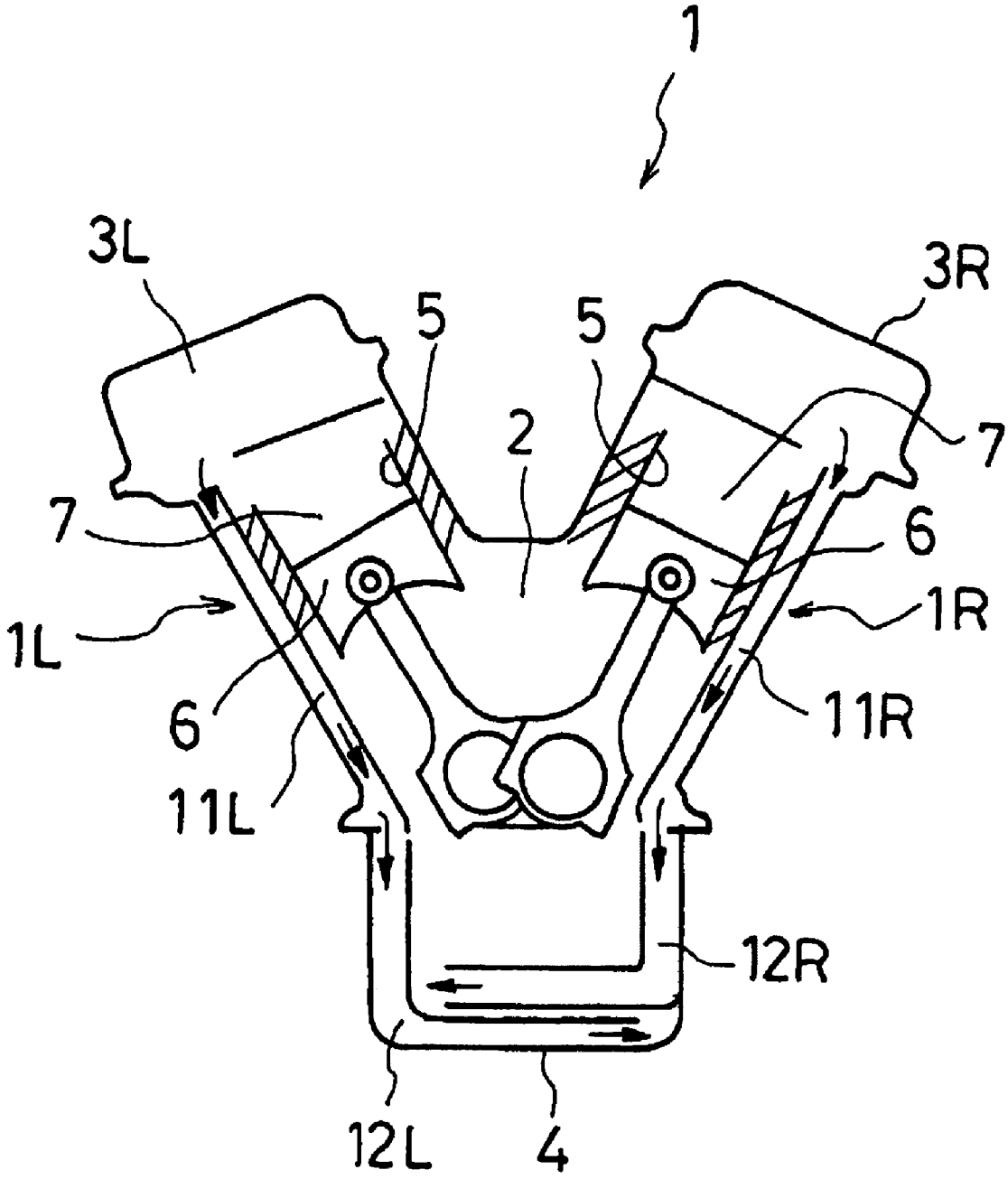
FIG. 1 is a schematic view of an embodiment of a structure of an engine oil return device.

While the claims are not limited to the illustrated embodiments, an appreciation of various aspects of the apparatus is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

FIG. 1 is a schematic view of an embodiment of an oil return device. FIG. 1 illustrates an internal combustion engine 1 that is installed in an automobile.

In the embodiment depicted, the engine 1 is a V-type engine that includes a left bank 1L and a right bank 1R. The engine 1 also includes a cylinder block 2, a cylinder head 3L for the left bank 1L, a cylinder head 3R for the right bank 1R, and an oil pan 4. In the cylinder block 2, a cylinder bore column of the left bank 1L and a cylinder bore column of the right bank 1R are disposed in generally a V shape. The cylinder head 3L and the cylinder head 3R are mounted to the cylinder block 2, and form, along with cylinder bores 5 and pistons 6, respective combustion chambers 7. The oil pan 4 is mounted to a lower side of the cylinder block 2.

Oil (lubricating oil) stored in the oil pan 4 is sucked up by an oil pump (not shown), driven by the engine 1. The oil is supplied to the cylinder heads 3L and 3R, and lubricates, for example, a suction/exhaust valve and/or a cam shaft at each of the cylinder heads 3L and 3R. Then, the oil returns to the oil pan 4, and is sucked up again by the oil pump to forcefully circulate the oil in the engine 1.

In the embodiment shown, oil return main paths 11L and oil return main paths 11R are provided. Oil return main paths 11L and 11R serve to return the oil to the oil pan 4 from the cylinder heads 3L and 3R at the respective banks. In the embodiment shown in FIG. 1, oil return main paths 11L and 11R may be integrated to the cylinder block 2.

Figure 2:
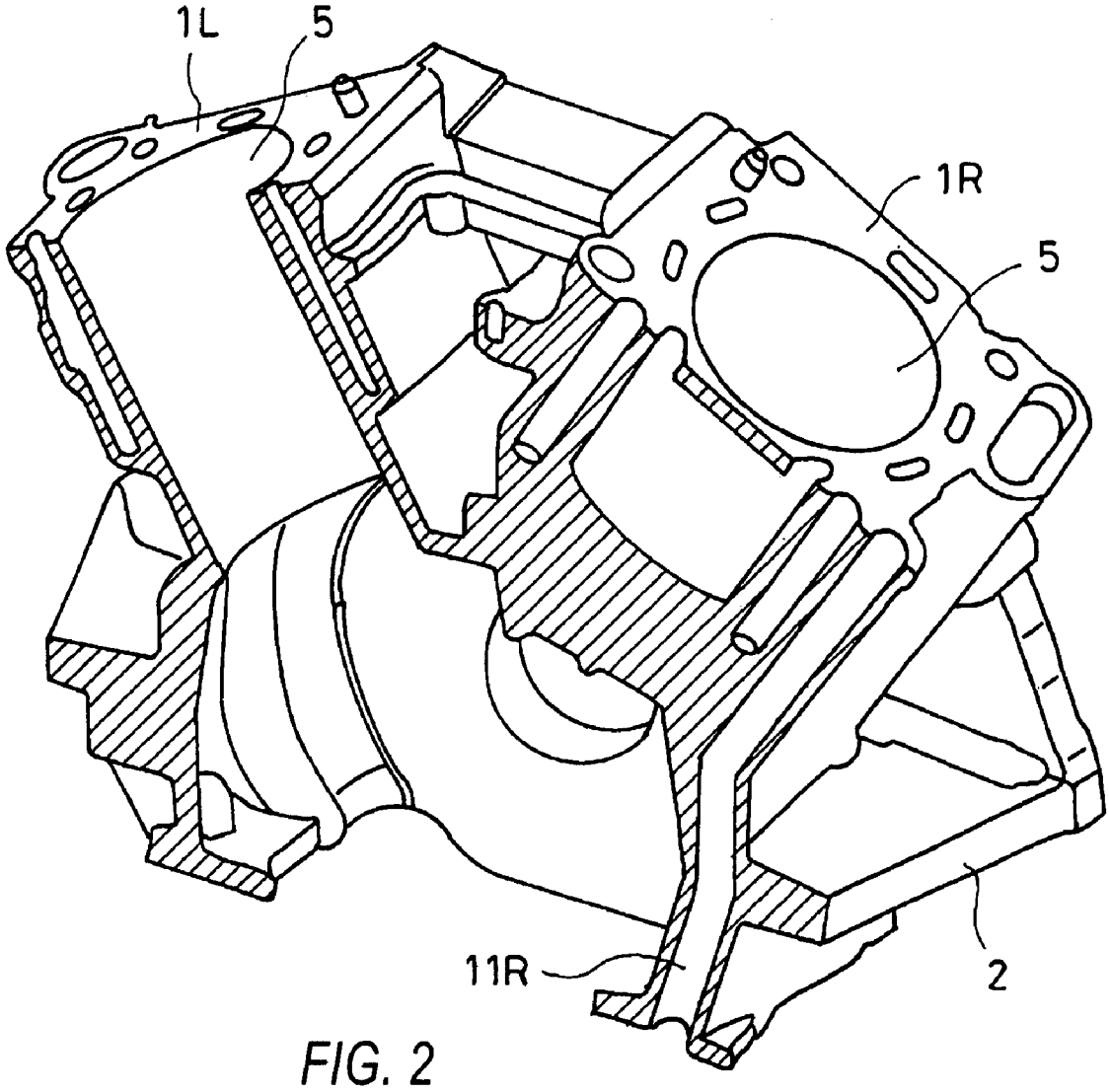
FIG. 2 is a perspective sectional view of a cylinder block where oil return main paths are provided in the embodiment.

As shown in FIGS. 1 and 2, the oil return main paths 11L and 11R are provided along inclined side surfaces of the respective banks 3L and 3R that are situated at lower sides of cylinder shafts. In other words, in the embodiment shown, the oil return main paths 11L and 11R are positioned along left and right side surfaces of the cylinder block 2.

One end of each of the oil return main paths 11L and 11R is open at an upper end surface of the cylinder block 2 to which the cylinder heads 3L and 3R are mounted. The other end of each of the oil return main paths 11L and 11R is also open at a lower end surface of the cylinder block 2 to which the oil pan 4 is mounted.

The oil that has lubricated each portion of the cylinder heads 3L and 3R fall into the oil return main paths 11L and 11R due to gravitational force, and is returned to the oil pan 4.

Here, in the engine 1 according to an embodiment, an oil return extension path 12L and an oil return extension path 12R, are connected to the downstream open ends positioned at the lower end surface of the cylinder block 2 of the oil return main paths 11L and 11R, respectively. The oil return extension paths 12L and 12R are in communication with the oil pan 4.

Figure 3:
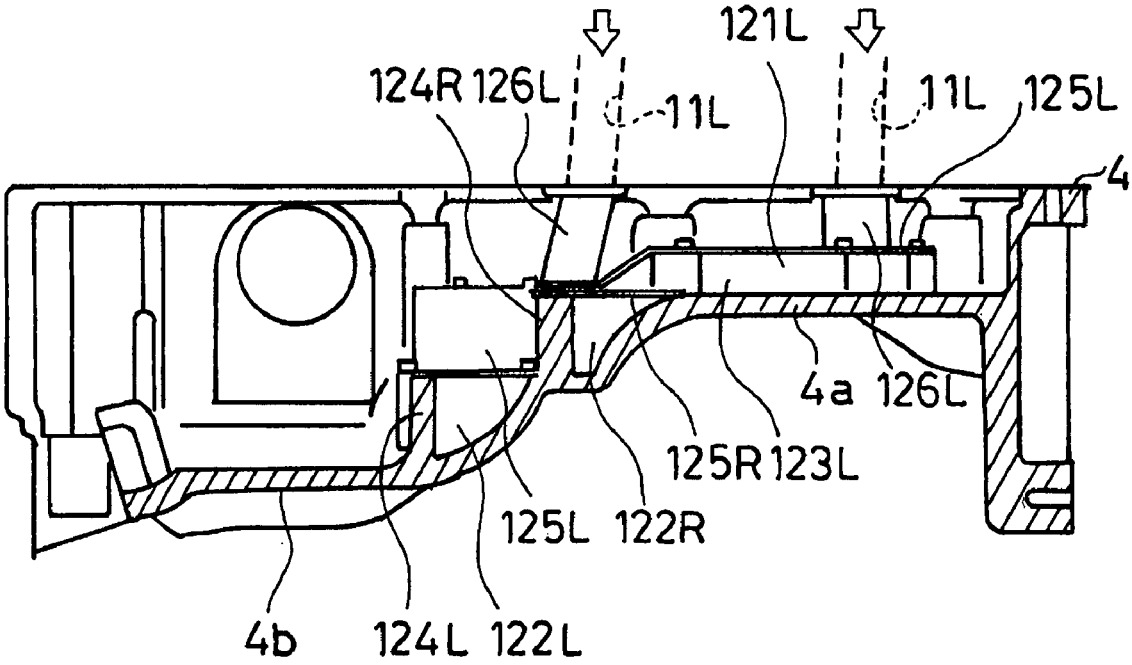
FIG. 3 is a transverse sectional view of an oil pan where oil return extension paths are provided in the embodiment.
Figure 4:
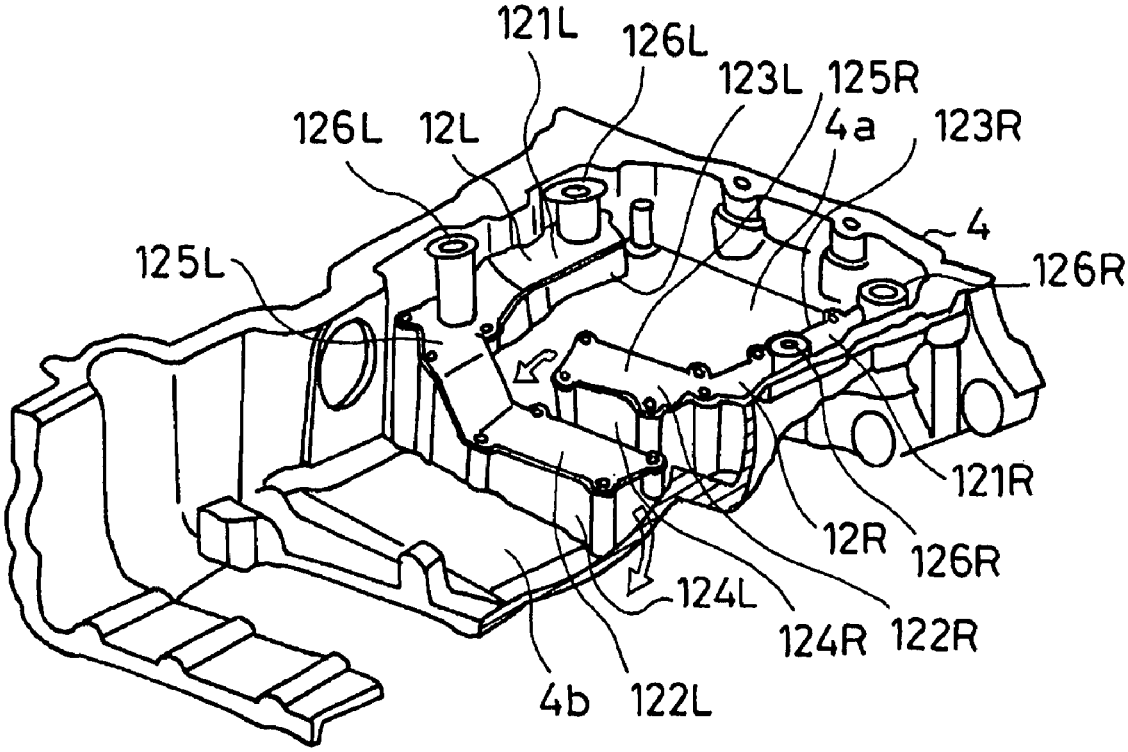
FIG. 4 is a perspective view of the oil pan of FIG. 3 where the oil return extension paths are provided in the embodiment.

As shown in FIGS. 3 and 4, the oil pan 4 has a shallow bottom portion 4*a* and a deep bottom portion 4*b* that are connected together. In one embodiment, the deep bottom portion 4*b* is formed integrally with the shallow bottom portion 4*b*. Oil in the deep bottom portion 4*b* is sucked up by the oil pump, and the oil return main paths 11L and 11R (shown in phantom) are open above the shallow bottom portion 4*a*.

The oil return extension paths 12L and 12R extend from respective connection portions (where they are connected to the downstream ends of the oil return main paths 11L and 11R) towards the bottom surface of the shallow bottom portion 4*a*. Then, oil return extension paths 12L and 12R extend from the shallow bottom portion 4*a*, situated directly below the oil return main paths 11L and 11R, towards the deep bottom portion 4*b* in a cylinder column direction. At a boundary between the shallow bottom portion 4*a* and the deep bottom portion 4*b*, oil return extension paths 12L and 12R substantially perpendicularly change directions towards the respective opposite banks (that is, the right bank 1R and the left back 1L). Downstream ends of portions of the oil return extension paths 12L and 12R extending towards their respective opposite banks, open into the oil pan 4, as shown by the arrows in FIG. 4.

The portions of the oil return extension paths 12L and 12R extending towards the respective opposite banks are disposed in the cylinder column direction (that is, in the direction in which the shallow bottom portion 4*a* and the deep bottom portion 4*b* are disposed in parallel) one after the other. The portion of the oil return extension path 12R extending towards the left bank 1L is disposed towards the shallow bottom portion 4*a* as compared to the portion of the oil return extension path 12L extending towards the right bank 1R.

In one embodiment, an upper surface of the portion of the oil return extension path 12R extending towards the left bank 1L is formed substantially flush with or lower than the shallow bottom portion 4*a* (see, e.g., FIG. 3). The upper surface of the portion of the oil return extension path 12L extending towards the right bank 1R is formed lower than the oil return extension path 12R. The upper surfaces defining the oil return extension paths 12L and 12R form the bottom surface of the oil pan that becomes deeper in steps from the shallow bottom portion 4*a* to the deep bottom portion 4*b*.

The oil return extension paths 12L and 12R are formed by inner walls of the oil pan 4, plate portions (ribs), and sheet plates. The ribs are integrally formed with the bottom surface of the oil pan 4 in a standing manner. The sheet plates cover grooves defined by the ribs and the inner walls of the oil pan 4.

To form first extension portions 121L and 121R for allowing oil that has been returned to the oil pan 4 through the oil return main paths 11L and 11R to flow towards the deep bottom portion 4*b* with each bank, plate portions 123L and 123R are provided in a standing manner at the bottom surface of the shallow bottom portion 4*a* so as to be substantially parallel to the inner walls of the oil pan 4. Grooves are formed by the plate portions 123L and 123R and the inner walls of the oil pan 4.

In addition, to form second extension portions 122L and 122R continuously with the respective first extension portions 121L and 121R and towards their respective opposite banks, plate portions 124L and 124R are formed at the bottom surface of the shallow bottom portion 4*a*. Grooves are formed by the plate portions 124L and 124R at a portion that becomes gradually deeper from the shallow bottom portion 4*a* towards the deep bottom portion 4*b*. These grooves traverse a location between the respective banks.

Here, the second extension portion 122R is positioned towards the shallow bottom portion 4*a* compared to the second extension portion 122L, and second extension portion 122R extends at a higher location than the second extension portion 122L. Oil that has flown out from an opening at one end of the second extension portion 122R crosses the top portion of the second extension portion 122L, and flows towards the deep bottom portion 4*b*.

Sheet plates 125L and 125R are secured over the grooves formed by the first extension portions 121L and 121R and over the grooves formed by the second extension portions 122L and 122R, respectively, so as to continuously cover the grooves and define a channel therein. In one embodiment, sheet plates 125L and 125R are secured by screws, although other suitable securing mechanisms may be employed.

In one embodiment, cylindrical connection portions 126L and cylindrical connection portions 126R are integrally provided at portions of the sheet plates 125L and 125R where the first extension portions 121L and 121R are formed.

Upper open ends of the connection portions 126L and 126R may be provided with flanges, and are aligned with the downstream open ends of the oil return main paths 11L and the downstream open ends of the oil return main paths 11R, provided at the cylinder block 2. The downstream open ends of the oil return main paths 11L and 11R and the upper open ends of the connection portions 126L and 126R oppose each other at close distances to each other.

During operation of the engine 1, the oil that has been returned through the oil return main paths 11L and 11R flow into the connection portions 126L and 126R. From the connection portions 126L and 126R, the oil then returns to the deep bottom portion 4*b* of the oil pan 4 through the first extension portions 121L and 121R and the second extension portions 122L and 122R.

Figure 5:
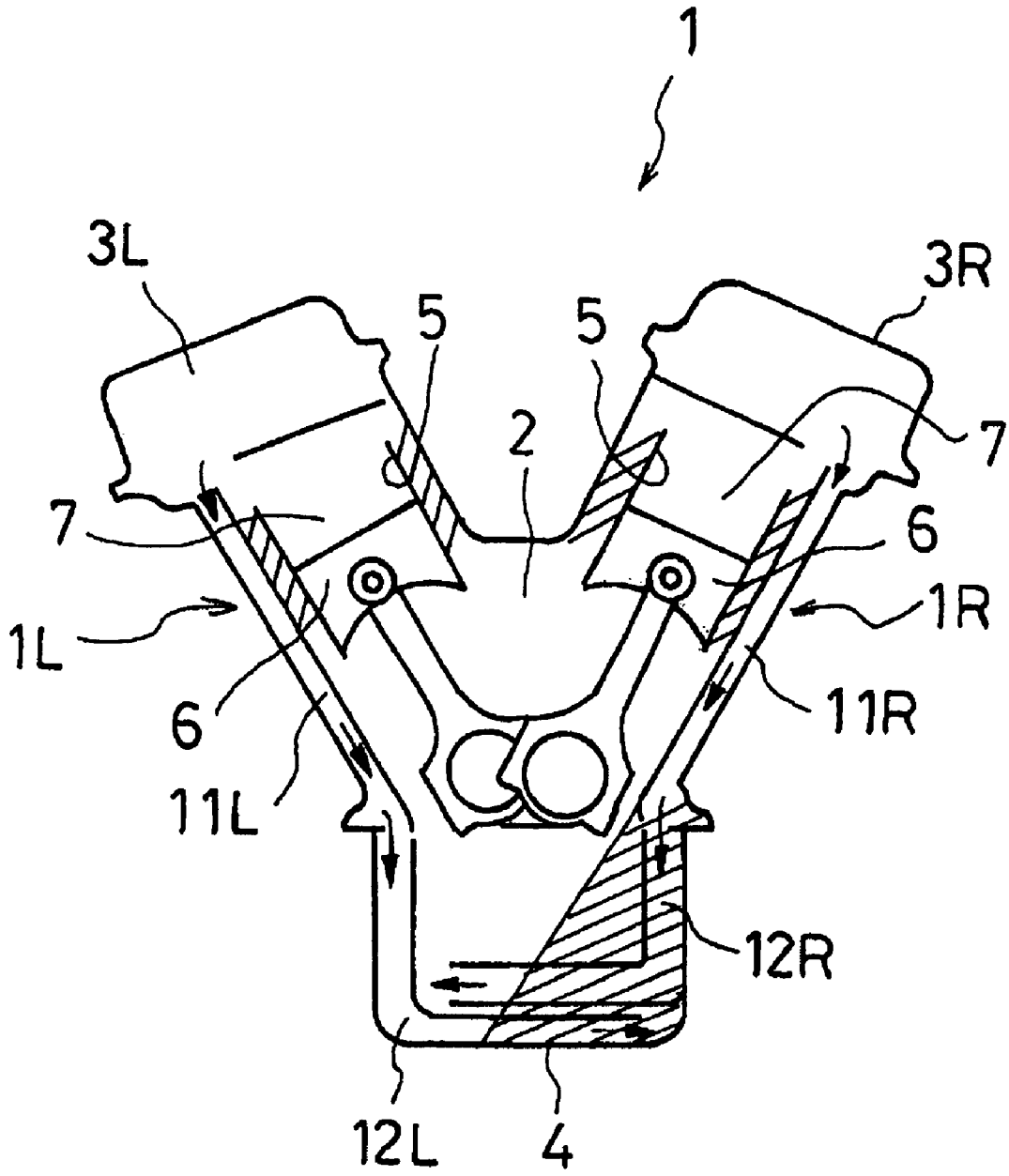
FIG. 5 shows a state that illustrates operation of the oil return device according to the embodiment.

According to the oil return device having the above-described structure, as shown, for example, in FIG. 5, when the engine 1 is inclined towards the right bank 1R, such that the oil is biased toward the right bank due to, for example, acceleration, deceleration, or turning of a vehicle; an oil level towards the left bank 1L is reduced. The open end of the oil return extension path 12R (which opens towards the left bank 1L) changes its state from an oil immersed state (in which it is immersed in the oil) to an exposed state (in which is no oil is present at the open end).

Therefore, even if the vehicle is considerably accelerated so that the oil is pushed towards the right bank 1R, the oil will not flow in the reverse direction through the oil return extension path 12R. Thus, the structure described herein permits return of the oil through the oil return extension path 12R under typical (i.e., non-inclined) operating conditions.

When the oil is inclined towards the right bank 1R, the oil level at the open end of the oil return extension path 12L is raised. Here, acceleration that pushes the oil towards the right bank 1R is produced. This acceleration is in a direction opposite to the direction of acceleration that causes the oil to flow through the oil return extension path 12L in the reverse direction. Therefore, oil does not flow in the reverse direction through the oil return extension path 12L, either.

Similarly, even if oil is inclined towards the left bank 1L due to, for example, acceleration, deceleration, or turning of a vehicle; oil does not flow in the reverse directions through the oil return extension paths 12L and 12R.

In contrast, however, if the oil return extension paths 12L and 12R of the present disclosure are not provided, and oil is directly returned to the oil pan 4 through the oil return main paths 11L and 11R that are formed at the cylinder block 2, when, for example, the oil is inclined towards the right bank 1R (or the left bank 1L) due to, for example, acceleration, deceleration, or turning of a vehicle; the oil return main path 11R (or the oil return main path 11L) opens into a side against which the oil is pushed, and the acceleration exerted upon the oil acts so as to cause the oil to flow into the oil return main path 11R (or the oil return main path 11L) in the reverse direction. Therefore, the oil may flow through the oil return main path 11R (or the oil return main path 11L) in the reverse direction, thereby hindering the returning of the oil to the oil pan 4.

If, as in the embodiment, the oil return extension paths 12L and 12R are formed by the sheet plates 125L and 125R and the plate portions (ribs) 123L, 123R, 124L, and 124R, which may be integrally formed with the oil pan 4, it is possible to form the oil return extension paths without increasing the number of parts.

Further, if, as in the embodiment, the second extension portions 122L and 122R extending towards the opposite banks at the oil return extension paths 12L and 12R are provided at the portion of the oil pan 4 that becomes gradually deeper from the shallow bottom portion 4*a* to the deep bottom portion 4*b*, it is possible to effectively use dead space within the oil pan 4, and to ensure sufficient clearance with respect to a rotating member (such as a crank journal). In addition, providing the oil return extension paths 12L and 12R can reduce an increase in friction.

In one embodiment, integrally providing the plate portions (ribs) 123L, 123R, 124L, and 124R at the oil pan 4 for forming the oil return extension paths 12L and 12R makes it possible to increase rigidity of the oil pan 4, thereby advantageously reducing noise and vibration of the engine 1.

Although, in the embodiment shown and described the engine 1 is described as being a V-type engine, the oil return device according to the embodiment including the oil return main paths 11L and 11R and the oil return extension paths 12L and 12R may be applied to a series engine.

In addition, although, in the embodiment, two oil return main paths 11L and 11R are provided at each bank 1L and 1R, the number of oil return main paths that are provided at each bank may be one or three or more.

By providing the second extension portions 122L and 122R of the oil return extension paths 12L and 12R so that they are as long as possible, and providing the open ends of the oil return extension paths 12L and 12R as far away as possible, reverse oil flow can be effectively prevented. The open ends of the oil return extension paths 12L and 12R may be set as appropriate on the basis of, for example, the form of the oil pan 4 or tilt angle of a cylinder shaft.

For example, the larger the tilt angle of the cylinder shaft (that is, the more horizontally the cylinder shaft is set), the more frequently reverse flow of oil may occur. Therefore, for example, if the inclination angles of the respective banks are different from each other with respect to a vertical of the V-type engine, it is possible to prevent reverse flow of oil at the banks as a result of providing an oil return extension path only at the bank having the larger inclination angle (so that an oil return extension path is not provided at the bank having the smaller inclination angle).

The preceding description has been presented only to illustrate and describe exemplary embodiments of the oil return device according to the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. An engine oil return device for an engine having a cylinder head and a cylinder block, comprising:

an oil pan; and an oil return path for returning oil that is supplied to the cylinder head, to the oil pan, wherein the oil return path includes at least one oil return main path and at least one oil return extension path;

wherein the at least one oil return main path is disposed at a first side surface of the cylinder block; and wherein the at least one oil return extension path includes an upstream end and a downstream end; wherein the upstream end of the at least one oil return extension path is connected to the at least one oil return main path and wherein the downstream end of the at least one oil return extension path is positioned at a distance from the first side surface of the cylinder block such that the oil return extension path extends in a direction of a second side surface of the cylinder block, and wherein at least a portion of said at least one oil return extension path is defined by a portion of the oil pan.

2. The engine oil return device according to claim 1, wherein the at least one oil return main path includes a plurality of oil return main paths; wherein the plurality of oil return main paths merge into one of the at least one oil return extension paths.

3. The engine oil return device according to claim 1, wherein the oil pan includes an inner wall, and the at least one oil return extension path is at least partially defined using a plate portion that is provided in a standing manner at the inner wall of the oil pan so as to define a groove.

4. The engine oil return device according to claim 3, wherein the at least one oil return extension path is further defined using a plate that covers the groove defined by the plate portion and inner wall.

5. The engine oil return device according to claim 1, wherein the at least one oil return extension path further comprises a connection portion extending from a downstream end of said at least one oil return main path towards a bottom surface of the oil pan.

6. The engine oil return device according to claim 1, wherein the at least one oil return extension path includes a plurality of oil return extension paths, and the oil pan further comprises a shallow bottom portion and a deep bottom portion, wherein the plurality of oil return extension paths are provided in parallel between the shallow bottom portion and the deep bottom portion, and wherein the plurality of oil return extension paths are defined by upper surfaces, and the upper surfaces form the bottom surface of the oil pan that becomes deeper in steps from the shallow bottom portion to the deep bottom portion.

7. The engine oil return device according to claim 6, wherein the plurality of oil extension paths each include upstream end of the oil return extension path is are disposed substantially perpendicular to the downstream end of the oil return extension path.

8. The engine oil return device according to claim 6, wherein said plurality of oil return extension paths includes first and second oil return extension paths and wherein the first of the oil return extension paths is formed so as to having a portion of an upper surface thereof be substantially flush with or lower than the shallow bottom portion.

9. The engine oil return device according to claim 8, wherein an upper surface of the second oil return extension path is formed so as to be disposed lower than the first oil return extension path.

10. An engine oil return device for an engine having a cylinder head and a cylinder block, comprising:

an oil pan; and an oil return path for returning oil that is supplied to the cylinder head, to the oil pan, wherein the oil return path includes a first oil return main path, a second oil return main path, a first oil return extension path, and a second oil return extension path, wherein the first oil return main path is disposed at a first side surface of the cylinder block and the second oil return main path is disposed at a second side surface of the cylinder block;

wherein an upstream end of the first oil return extension path is fluidly connected to the first oil return main path and a downstream end of the first oil return extension path being positioned a distance from the first side surface of the cylinder block in a direction of the second side surface of the cylinder block, and wherein an upstream end of the second oil return extension path is connected to the second oil return main path and a downstream end of the second oil return extension path is positioned a distance from the second side surface of the cylinder block in a direction of the first side surface of the cylinder block, and wherein at least a portion of the first oil return extension path and at least a portion of the second oil return extension path are defined by a portion of the oil pan.

11. An engine oil return device for an engine having a cylinder head and a cylinder block, comprising:

a pan means for storing oil;

an oil return means for returning oil that is supplied to the cylinder head, to the pan means;

wherein the oil return means includes a main path means disposed at a first side surface of the cylinder block and at least one extension path means;

wherein the at least one extension path means includes an upstream end that is connected to the at least one main path means and a downstream end that is positioned at a distance from the first side surface of the cylinder block such that the at least one extension path means extends in a direction of a second side surface of the cylinder block; and wherein at least a portion of the extension path means is defined by a portion of the pan means.

* * * * *